United States Patent [19]

Tatham et al.

[11] 4,377,889

[45] Mar. 29, 1983

[54] APPARATUS FOR CONTROLLING EDGE UNIFORMITY IN NONWOVEN FABRICS

[75] Inventors: Jack R. Tatham, Fair Play; Jerry L. Shelor, Walhalla, both of S.C.

[73] Assignee: Phillips Petroleum Company, Bartlesville, Okla.

[21] Appl. No.: 265,737

[22] Filed: May 21, 1981

Related U.S. Application Data

[62] Division of Ser. No. 130,631, Mar. 14, 1980, Pat. No. 4,295,251.

[51] Int. Cl.[3] ..... D04H 18/00

[52] U.S. Cl. ..... 28/112; 28/115

[58] Field of Search ..... 28/107, 109, 112, 115, 28/103, 104, 105, 106; 156/148; 428/234, 235

[56] References Cited

U.S. PATENT DOCUMENTS

| | | | |
|---|---|---|---|
| 430,230 | 6/1890 | Grubb | 28/107 |
| 1,726,680 | 9/1929 | Rayner | 28/107 |
| 2,132,530 | 10/1938 | Greiser | 28/112 X |
| 3,309,753 | 3/1967 | Astor | 28/4 |
| 3,451,885 | 6/1969 | Klein | 161/80 |
| 3,538,564 | 11/1970 | Skoler et al. | 28/72.2 |
| 3,613,190 | 10/1971 | Crosby | 28/109 |
| 3,747,161 | 7/1973 | Kalwaites | 28/105 |
| 3,829,939 | 8/1974 | Dilo | 28/107 |
| 3,837,054 | 9/1974 | Fehrer | 28/107 |
| 3,935,046 | 1/1976 | Kiernan et al. | 156/148 |
| 3,950,587 | 4/1976 | Colijn et al. | 428/234 |
| 4,069,563 | 1/1978 | Contractor et al. | 28/105 |
| 4,105,381 | 8/1978 | Platt et al. | 28/112 X |
| 4,113,827 | 9/1978 | Stoller | 264/280 |
| 4,117,578 | 10/1978 | Forsten | 28/112 |
| 4,131,704 | 12/1978 | Erikson et al. | 28/112 X |
| 4,199,644 | 4/1980 | Platt | 28/112 X |

FOREIGN PATENT DOCUMENTS

| | | | |
|---|---|---|---|
| 46-8955 | 3/1971 | Japan | 28/109 |
| 47-12913 | 4/1972 | Japan | 156/148 |
| 1556611 | 11/1979 | United Kingdom | 156/148 |

*Primary Examiner*—Robert Mackey

[57] ABSTRACT

An improved method of manufacture of a nonwoven fabric wherein a nonwoven fabric web is passed through a needle punching zone wherein the nonwoven fabric web is needle punched in such a manner that the number of needle punches per unit area in the edge portions of the nonwoven fabric web is less than the number of needle punches per unit area in the medial portion of the nonwoven fabric web, and the thus needled nonwoven fabric web is passed through a tentering zone wherein it is stretched transversely relative to its direction of movement to thereby reduce the weight per unit area of the edge portions to approximately the weight per unit area of the medial portion so that a nonwoven fabric of substantially uniform thickness and weight per unit area is produced. Also disclosed is apparatus comprising a needle punching machine with a needle board having a plurality of needles extending outwardly therefrom toward the nonwoven fabric web and arranged such that there are more needles per unit area adjacent the medial portion of the nonwoven fabric web than there are needles per unit area adjacent the edge portions of the nonwoven fabric web, and further including a tenter frame.

9 Claims, 5 Drawing Figures

10
12
14
16
18
20
22
24
26
28
30
32
34
40
42
44
46
48
50
52
56
5

APPARATUS FOR CONTROLLING EDGE UNIFORMITY IN NONWOVEN FABRICS

This is a division of application Ser. No. 130,631, filed Mar. 14, 1980 now U.S. Pat. No. 4,295,251 granted Oct. 20, 1981.

The invention relates generally to the production of nonwoven fabric. In one aspect, the invention relates to a method of producing a nonwoven fabric web of substantially uniform weights per unit area across its full width. In another aspect, the invention relates to apparatus suitable for carrying out such a method.

Nonwoven fabrics produced employing various staple fibers, such as, for example, polypropylene, nylon, polyvinyl chloride, cotton, wool, etc, are well known in the art. Various methods are known to produce such nonwoven fabrics from staple fibers. One method commonly employed involves forming a nonwoven fabric web by crosslapping carded webs of staple fibers using crosslappers, passing the nonwoven fabric web formed from the crosslapped carded webs to one or more needle looms to needle punch the nonwoven fabric which forces fibers in the various webs into one another thus entangling and thereby bonding the crosslapped carded webs together to provide integrity to the nonwoven fabric, and tentering the thus needled nonwoven fabric web, i.e. stretching the needled fabric web transversely relative to its line of movement. Such nonwoven fabrics, when fused on one or both sides, are useful for such products as carpet backing, upholstery stretching strips, mattress ticking, etc.

A relatively new use for such nonwoven fabrics which are generally unfused is for backing polymeric films to produce upholstery material as is known in the art. Although the use of such upholstery material has been accepted in the industry with considerable success, there is a problem in cutting the material into patterns. This problem is at least partially caused by the lack of uniformity in thickness or weight per unit area of such crosslapped nonwoven fabrics due to the fact that the crosslapping of the carded webs of staple fibers causes the edge portions of the resulting nonwoven fabric webs to be thicker or of greater weight per unit area than the medial portion of the resulting fabric web. The nonwoven fabric webs are customarily produced by the manufacturer in widths of approximately 15 feet (4.6 m). Since the upholstery industry generally manufactures upholstery goods in widths substantially less than 15 feet, such as, for example, approximately 4 feet, 6 inches, (1.38 m) the nonwoven fabric web with a width of 15 feet is cut into three 5-foot (1.54 m) widths by the nonwoven fabric manufacturer, and the resulting 5-foot widths are subsequently trimmed to 4 feet, 6 inches by the upholstery goods manufacturer. Thus, two of the resulting 5-foot widths of the original nonwoven fabric web have one edge thicker and of greater weight per unit area than the other edge. The resulting 5-foot widths of the original nonwoven fabric web are subsequently coated with a polymeric material generally employing the direct calender lamination or the post lamination technique known in the art to produce the nonwoven backed upholstery material.

As noted above it is common for the upholstery industry to cut such upholstery material into patterns. It is also common to cut a number of pieces of the material at the same time by cutting stacks of material, that is, cutting several pieces of the material which are stacked one on top of the other. A problem arises when cutting stacks of the material because the two 4-foot, 6-inch width pieces made from the 5-foot width outside edge pieces of the original 15-foot width nonwoven fabric web material do not have a uniform thickness or uniform weight per unit area. When the nonwoven backed upholstery material is stacked for cutting, the nonuniformity of the nonwoven backing material is magnified which often results in poor pattern definition. The present invention provides method and apparatus useful in producing a nonwoven fabric with a uniform thickness and uniform weight per unit area which results in the elimination of the above-described cutting problems when such fabric is used as the backing in the upholstery material.

An object of the invention is to produce a nonwoven fabric with a uniform thickness.

Another object of the invention is to produce a nonwoven fabric of substantially uniform weight per unit area.

Yet another object of the invention is to reduce the thickness of the edges of a nonwoven fabric formed by crosslapping webs.

Still another object of the invention is to reduce the weight per unit area of the edges of a nonwoven fabric formed by crosslapping webs.

Another object of the invention is to reduce the weight of fabric scrap when the edges of nonwoven fabric webs are trimmed.

Yet another object of the invention is to provide apparatus suitable for the production of a nonwoven fabric having a uniform thickness.

Still another object of the invention is to provide apparatus suitable for the production of a nonwoven fabric of substantially uniform weight per unit area.

According to the present invention, a nonwoven fabric, having edge portions and a medial portion wherein the weight per unit area of the edge portions is greater than the weight per unit area of the medial portion, is passed through a needle punching zone wherein the fabric is needle punched in such a manner that the number of needle punches per unit area in the edge portions of the fabric is less than the number of needle punches per unit area in the medial portion of the fabric, and the thus needled fabric is passed through a tentering zone wherein the fabric is stretched transversely relative to its direction of movement to thereby reduce the weight per unit area of the edge portions to approximately the weight per unit area of the medial portion so that a nonwoven fabric of substantially uniform thickness and weight per unit area is produced.

Other objects, advantages and aspects of the invention will be readily apparent to those skilled in the art from a reading of the following detailed description and claims and a study of the accompanying drawings in which:

Figures 1, 2, 3:
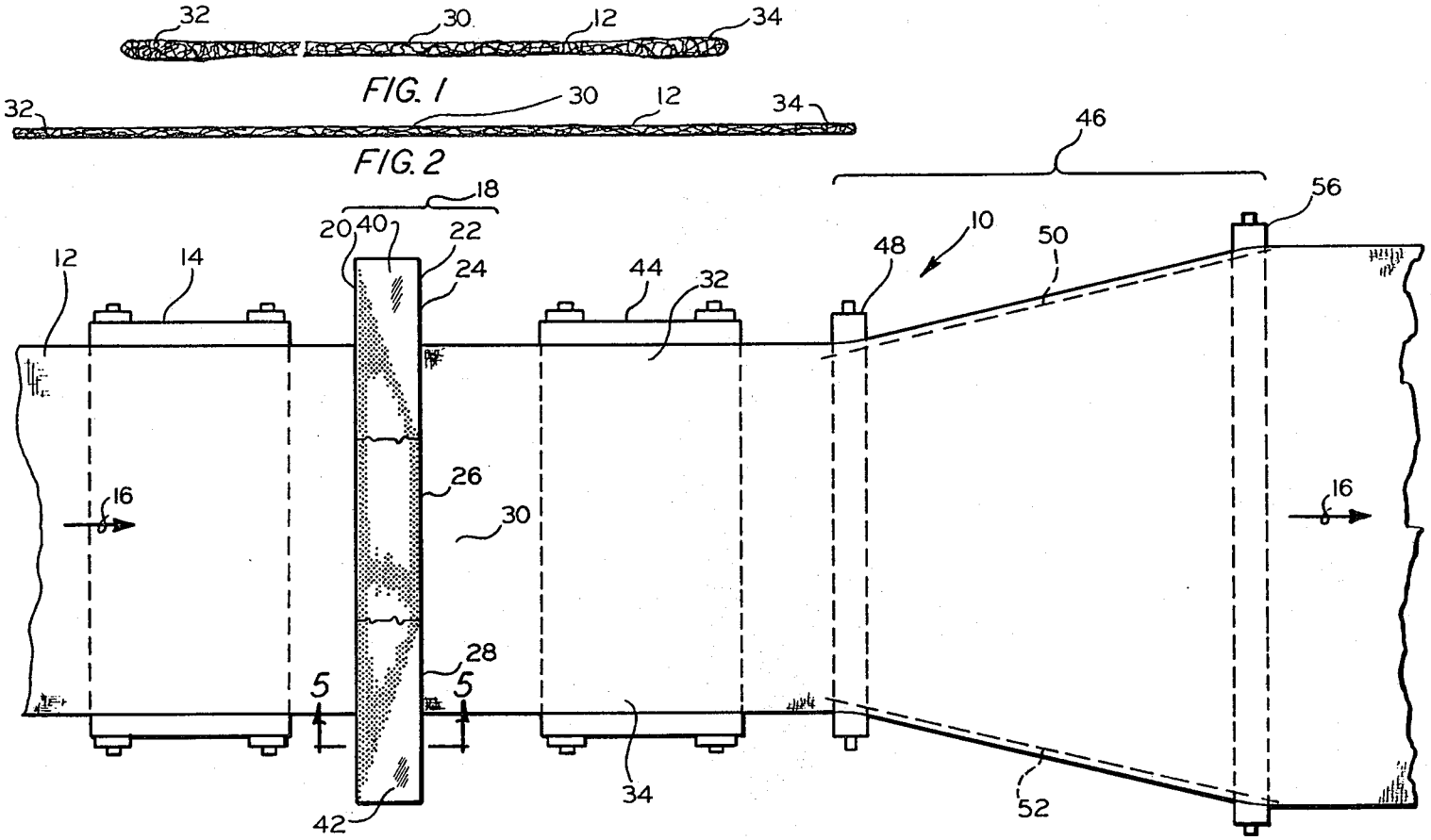
FIG. 1 is a schematic representation of the cross section of the width of a nonwoven fabric before being processed in accordance with the invention.
FIG. 2 shows the cross section of the width of a nonwoven fabric of FIG. 1 after being processed in accordance with the invention.
FIG. 3 is a schematic plan of apparatus constructed in accordance with the invention.
Figure 4:
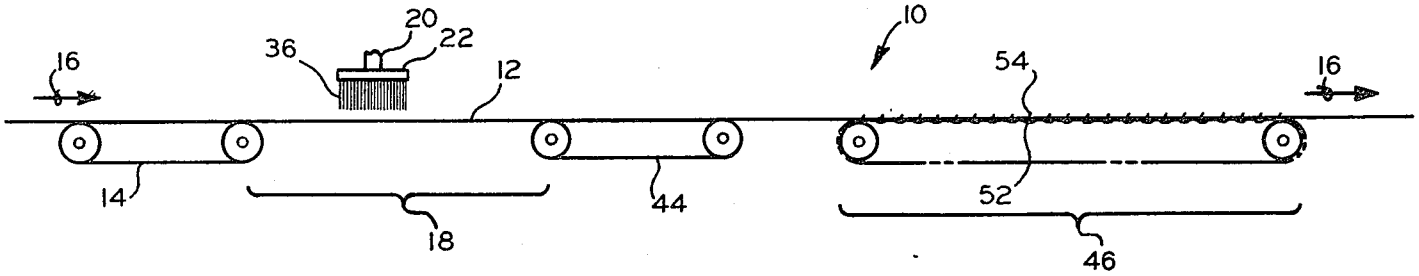
FIG. 4 is a schematic side elevation of the apparatus of FIG. 3.

Referring now to the drawings, apparatus generally designated by the reference character 10 is depicted therein and is adapted for sequentially needle punching and tentering or drafting a nonwoven fabric web 12. The nonwoven fabric web 12 is suitably formed by crosslapping carded webs of staple fibers, such as polypropylene, nylon or polyvinyl chloride staple fibers, using conventional crosslappers (not shown). The thus formed nonwoven fabric web 12 is fed by a suitable conveyor 14 in the direction indicated by the arrows 16 into the needle punching zone 18 of the apparatus 10.

The needle punching zone 10 includes a needle punching machine or needle loom 20 which includes a needle board assembly 22 comprising three needle boards 24, 26 and 28. The needle boards 24, 26 and 28 are positioned end to end to form the needle board assembly 22 which extends across the fabric web 12 as shown in FIG. 3. The medial needle board 26 is positioned above the medial portion 30 of the fabric web 12 while the outer needle boards 24 and 28 extend from the respective opposite ends of the medial needle board 26 and are positioned above the respective opposite edge portions 32 and 34 of the fabric web 12.

Figure 5:
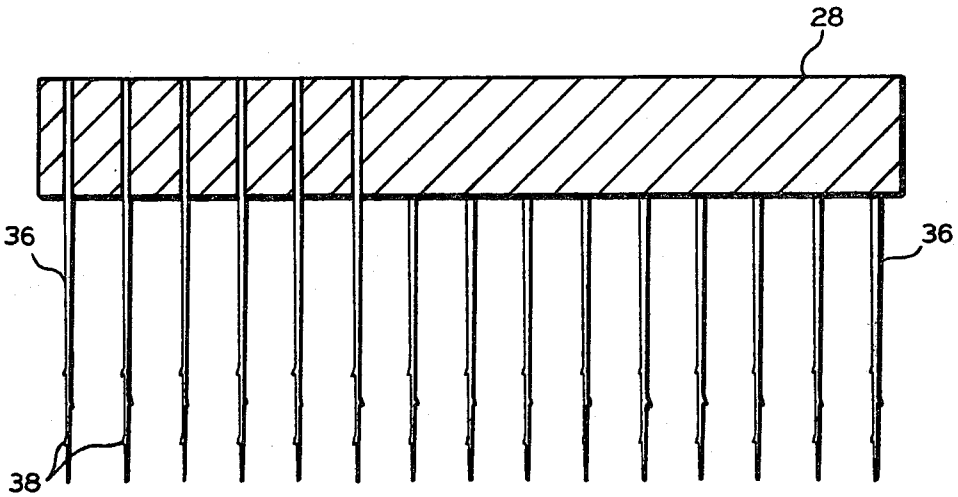
FIG. 5 is an enlarged partial cross section taken along line 5—5 of FIG. 3 showing a needle board constructed in accordance with the present invention.

Each of the needle boards of the needle board assembly 22 is provided with a plurality of needles 36 mounted therein and extending outwardly therefrom toward the fabric web 12 in spaced, mutually parallel relation. As best shown in FIG. 5, each needle 36 is provided with a suitable number of barbs 38 which extend outwardly and toward the fabric web from the shank of the needle. The number of barbs 38 on a needle 36 is determined by the physical characteristics of the fabric web and the degree of fiber entanglement desired in the needled fabric web. It is presently preferred to use needles having three barbs in the needle board assembly 22.

The needle punching machine or needle loom 20 is provided with suitable means (not shown) for causing continuous reciprocating movement of the needle board assembly 22 between a first position with the needles 36 disengaged from the fabric web 12 and a second position with the needles 36 penetrating the fabric web 12 to a depth sufficient to cause full penetration of the fabric web by all of the barbs on each needle.

The needles 36 of the medial needle board 26 are preferably substantially uniformly spaced one from the other across the full surface of the needle board 26. This arrangement provides a substantially uniform needle punching density per unit area in the medial portion of the fabric web. The needles 36 of the two outer needle boards 24 and 28 are arranged in these outer needle boards so as to achieve a needle punching density per unit area in the two edge portions 32 and 34 of the fabric web 12 which is less than the needle punching density per unit area in the medial portion 30 of the fabric web 12. This variation in needle punching density between the medial and edge portions of the fabric web 12 can be suitably achieved by reducing the number of needles per unit area in the outer needle boards 24 and 28 proximate the edge portions 32 and 34 of the fabric web 12 in comparison with the number of needles per unit area in the medial needle board 26. One suitable method of achieving this reduction of the number of needles per unit area in the outer needle boards 24 and 28 is to omit needles from triangular areas 40 and 42 of the respective needle boards 24 and 28 as shown in FIG. 3. Such an arrangement of needles in the needle boards 24 and 28 results in a linear reduction of the number of needles per unit area from the medial portion 30 of the fabric web 12 transversely outwardly toward the outer edge portions 32 and 34. It will be readily apparent to those skilled in the art that other arrangements or schemes for the positioning of needles in the needle boards 24 and 28 can be employed with equally good results to achieve the desired reduction in needle punching density per unit area at the outer edge portions 32 and 34 in comparison to the needle punching density per unit area of the medial portion 30 of the fabric web 12.

After needle punching in the needle punching zone 18, the thus needle punched fabric web 12 is fed by a suitable conveyor 44 to fabric stretching means in the form of a conventional tenter apparatus or frame 46. At a first position 48, two endless chains 50 and 52 respectively engage the edge portions 32 and 34 of the fabric web 12 with a series of hooks 54 mounted on the chains and simultaneously convey the thus engaged fabric to a second position 56 and stretch the fabric web transversely relative to its direction of travel 16. A cross section of the fabric web 12 upon entering the first position 48 of the tenter frame 46 is illustrated in FIG. 1 and shows schematically the difference in thickness between the edge portions 32 and 34 and the medial portion 30 of the unstretched fabric web 12. A similar cross section of the fabric web upon exiting the second position 56 of the tenter frame 46 is illustrated in FIG. 2 and shows schematically the uniformity of thickness of the medial and edge portions 30, 32 and 34 of the transversely stretched fabric web 12. It will be understood that the substantially uniform thickness achieved by the transverse tentering or stretching of the fabric web 12 in the tenter frame 46 is accompanied by reduction of the weight of the fabric web 12 per unit area in the edge portions 32 and 34 to approximately the weight per unit area of the medial portion 30 of the fabric web 12.

Subsequent to the tentering or stretching of the fabric web 12 transversely relative to its direction of movement 16, the thus produced nonwoven fabric web of substantially uniform thickness is conveyed from the tenter frame 46 by suitable conventional web conveying means (not shown) for further processing of the nonwoven fabric web. One form of further processing involves slitting or cutting the fabric web into a plurality of nonwoven fabric webs of substantially equal width. For example, a nonwoven fabric web 12 having a width of approximately 15 feet (4.6 meters) upon leaving the tentering zone may be conveniently slit or cut into three webs of approximately 5 feet (1.54 meters) in width. It may further be desirable to trim the edges or selvages of such narrower webs by about 3 inches (7.6 cm) on each edge portion of produce nonwoven webs of approximately 4 feet 6 inches (1.38 meters) in width for use in the manufacture of upholstery goods. The substantially uniform thickness of these narrower webs facilitates pattern cutting of stacks of such upholstery goods as well as reduces the amount of material waste when the selvages are trimmed.

The method and apparatus described above overcomes the previously described problems in the manufacture and use of nonwoven fabric because the less dense needle punching and resulting reduced fiber entanglement or bonding among the staple fibers of the edge portions 32 and 34 of the nonwoven fabric web 12 relative to the fiber entanglement or bonding among the staple fibers of the medial portion 30 permits proportionally greater transverse stretching of the fabric web in the thicker or heavier edge portions 32 and 34 than in the thinner or lighter medial portion 30.

Changes may be made in the combination and arrangement of parts or elements as heretofore set forth in the specification and shown in the drawings without departing from the spirit and scope of the invention as defined in the following claims.

We claim:

1. Apparatus comprising in combination:

conveying means for conveying a nonwoven fabric web along a line of direction;

needle punching means disposed adjacent said line of direction for needle punching a nonwoven fabric web conveyed therealong, said nonwoven web having a medial portion and opposite edge portions, and said needle punching means comprising a needle board disposed across said nonwoven fabric web and having a plurality of needles extending outwardly therefrom toward said nonwoven fabric web and arranged such that said needles are disposed across at least the full width of said nonwoven fabric web and there are more needles per unit area adjacent the medial portion of said nonwoven fabric web than there are needles per unit area adjacent the opposite edge portions; and fabric stretching means disposed adjacent said line of direction for stretching said nonwoven fabric web transversely relative to said line of direction subsequent to needle punching by said needle punching means, whereby the transverse stretching of the opposite edge portions is greater than the transverse stretching of the medial portion of said nonwoven fabric web.

2. Apparatus in accordance with claim 1 wherein said needles each include at least one barb means thereon for engaging said nonwoven fabric web during needle punching by said needle punching means.

3. Apparatus in accordance with claim 2 wherein said needle punching means is characterized further to include:

means for causing reciprocating movement of said needle board between a first position with the needles disengaged from said nonwoven fabric web and a second position with the needles penetrating said nonwoven fabric web to a depth sufficient to cause full penetration of said nonwoven fabric web by all of the barbs on each of the needles.

4. Apparatus in accordance with claim 1 wherein said needle punching means is characterized further to include:

means for causing reciprocating movement of said needle board between between a first position with the needles disengaged from said nonwoven fabric web and a second position with the needles penetrating said nonwoven web.

5. Apparatus for needle punching a fabric web having a medial portion and opposite edge portions, said apparatus comprising:

needle board means comprising a needle board disposed across said fabric web and having a plurality of needles extending outwardly therefrom toward said fabric web for needle punching said fabric web, said needles being arranged such that said needles are disposed across at least the full width of said fabric web and there are more needles per unit area in the portion of said needle board adjacent the medial portion of said fabric web than there are needles per unit area in the portions of the needle board adjacent the opposite edge portions of said fabric web; and fabric stretching means disposed adjacent said fabric web for engaging the opposite edge portions of said fabric web and stretching said fabric web after needle punching of said fabric web by said needle board means, whereby the stretching of the opposite edge portions is greater than the stretching of the medial portion of said fabric web.

6. Apparatus in accordance with claim 5 wherein the number of needles per unit area in said needle board progressively decreases between the portion of said needle board adjacent the medial portion of said fabric web and each of the portions of said needle board adjacent the opposite edge portions of said fabric web.

7. Apparatus in accordance with claim 5 wherein the number of needles per unit area in said needle board decreases linearly between the portion of said needle board adjacent the medial portion of said fabric web and each of the portions of said needle board adjacent the opposite edge portions of said fabric web.

8. Apparatus in accordance with claim 5 wherein said needles each include at least one barb means thereon for engaging said fabric web during needle punching by said apparatus.

9. Apparatus in accordance with claim 5 characterized further to include:

means for causing reciprocating movement of said needle board between a first position with the needles disengaged from said fabric web and a second position with the needles penetrating said fabric web.

* * * * *